US010238156B2

(12) United States Patent
Cumiskey et al.

(10) Patent No.: US 10,238,156 B2
(45) Date of Patent: Mar. 26, 2019

(54) SUIT FOR ATHLETIC ACTIVITIES

(71) Applicant: Under Armour, Inc., Baltimore, MD (US)

(72) Inventors: Mark Cumiskey, Baltimore, MD (US); Kevin Fallon, Baltimore, MD (US); Chris Laughman, Baltimore, MD (US); Diaa Abbas, Baltimore, MD (US)

(73) Assignee: UNDER ARMOUR, INC., Baltimore, MD (US)

( * ) Notice: Subject to any disclaimer, the term of this patent is extended or adjusted under 35 U.S.C. 154(b) by 196 days.

(21) Appl. No.: 14/994,709

(22) Filed: Jan. 13, 2016

(65) Prior Publication Data

US 2018/0035727 A1 Feb. 8, 2018

Related U.S. Application Data

(60) Provisional application No. 62/102,802, filed on Jan. 13, 2015.

(51) Int. Cl.
*A41D 13/00* (2006.01)

(52) U.S. Cl.
CPC ..... *A41D 13/0015* (2013.01)

(58) Field of Classification Search
CPC ..... A41D 13/0015
See application file for complete search history.

(56) References Cited

U.S. PATENT DOCUMENTS

| | | | |
|---|---|---|---|
| 3,835,470 | A | 9/1974 | Greiter |
| 4,179,754 | A | 12/1979 | Denu |
| 4,268,238 | A | 5/1981 | Marc |
| 4,306,317 | A | 12/1981 | Joseph |
| 4,441,876 | A | 4/1984 | Marc |
| 4,524,037 | A | 6/1985 | Marc |
| 4,851,167 | A | 7/1989 | Marc |
| 4,972,522 | A | 11/1990 | Rautenberg |
| 5,033,116 | A | 7/1991 | Itagaki et al. |
| 5,052,053 | A | 10/1991 | Peart et al. |
| 5,359,735 | A | 11/1994 | Stockwell |
| 5,371,903 | A | 12/1994 | Lew |
| 5,380,578 | A | 1/1995 | Rautenberg |
| 5,415,924 | A | 5/1995 | Herlihy, Jr. |
| 5,631,074 | A | 5/1997 | Herlihy, Jr. |
| 5,734,990 | A | 4/1998 | Waring |
| 5,809,567 | A | 9/1998 | Jacobs et al. |

(Continued)

FOREIGN PATENT DOCUMENTS

| | | | |
|---|---|---|---|
| DE | 2935780 | A1 | 4/1981 |
| EP | 0962313 | B1 | 8/2006 |

(Continued)

*Primary Examiner* — Clinton Ostrup
*Assistant Examiner* — Andrew W Sutton
(74) *Attorney, Agent, or Firm* — Edell, Shapiro & Finnan, LLC

(57) ABSTRACT

A suit wearable by a human user includes a torso section, two arm sections extending from an upper portion of the torso section, and two leg sections extending from a lower portion of the torso section. At least one of an arm section and a leg section includes at least one exterior surface region that is uneven and having at least one of a different surface friction property and a different surface roughness property in relation to at least one exterior surface region of the torso section.

9 Claims, 14 Drawing Sheets

(56) References Cited

U.S. PATENT DOCUMENTS

| | | | | |
|---|---|---|---|---|
| 5,819,322 | A | 10/1998 | Dicker et al. | |
| 5,836,016 | A | 11/1998 | Jacobs et al. | |
| 5,887,280 | A | 3/1999 | Waring | |
| 6,098,198 | A | 8/2000 | Jacobs et al. | |
| 6,438,755 | B1 | 8/2002 | MacDonald et al. | |
| 6,484,319 | B1 | 11/2002 | Fusco et al. | |
| 6,546,560 | B2 | 4/2003 | Fusco et al. | |
| D602,677 | S | 10/2009 | Cowan | |
| D608,981 | S | 2/2010 | Cowan | |
| 7,856,668 | B2 | 12/2010 | Demarest et al. | |
| 7,941,869 | B2 | 5/2011 | Wright et al. | |
| 8,082,595 | B2 | 12/2011 | Nordstrom | |
| 8,185,971 | B2 | 5/2012 | Wright et al. | |
| 8,286,262 | B2 | 10/2012 | Rance et al. | |
| 8,347,413 | B2 | 1/2013 | Wright et al. | |
| 8,375,465 | B2 | 2/2013 | Whaley | |
| 8,539,615 | B1 | 9/2013 | Carver | |
| 8,745,769 | B2 | 6/2014 | Wright et al. | |
| 2006/0085889 | A1 | 4/2006 | Okajima | |
| 2006/0200890 | A1 | 9/2006 | Prat Gonzalez | |
| 2006/0277653 | A1 | 12/2006 | Okajima | |
| 2008/0078008 | A1 | 4/2008 | Demarest et al. | |
| 2008/0141431 | A1 | 6/2008 | Rance et al. | |
| 2008/0189825 | A1 | 8/2008 | Wright et al. | |
| 2008/0196136 | A1* | 8/2008 | Fellouhe | A41D 27/245 2/69 |
| 2011/0162122 | A1 | 7/2011 | Wright et al. | |
| 2012/0131720 | A1 | 5/2012 | Nordstrom et al. | |
| 2012/0174282 | A1* | 7/2012 | Newton | A41D 13/0015 2/69 |
| 2012/0266353 | A1* | 10/2012 | Ferre | A41D 13/0012 2/125 |
| 2012/0304359 | A1 | 12/2012 | Bybee et al. | |
| 2013/0198926 | A1 | 8/2013 | Rod, III et al. | |
| 2013/0212767 | A1 | 8/2013 | Nordstom et al. | |
| 2014/0313037 | A1* | 10/2014 | Canales | A41D 13/012 340/573.1 |
| 2017/0027248 | A1* | 2/2017 | McFarlane | G06Q 10/063 |
| 2017/0079339 | A1* | 3/2017 | Yeomans | A41D 7/005 |
| 2017/0215492 | A1* | 8/2017 | Canales | A41D 7/00 |

FOREIGN PATENT DOCUMENTS

| | | | |
|---|---|---|---|
| JP | H03137203 | A | 6/1991 |
| JP | H03137204 | A | 6/1991 |
| JP | H07331513 | A | 12/1995 |
| JP | H10140407 | A | 5/1998 |
| JP | H10280222 | A | 10/1998 |
| JP | 2000064107 | A | 2/2000 |
| JP | 2003105608 | A | 4/2003 |
| JP | 2006037311 | A | 2/2006 |
| NL | 198800542 | A | 10/1989 |
| NL | 1040558 | C | 6/2015 |
| RU | 2518994 | C1 | 6/2014 |
| WO | 9708966 | A1 | 3/1997 |
| WO | 0045658 | A1 | 8/2000 |
| WO | 2009133433 | A1 | 11/2009 |
| WO | 2010072811 | A1 | 7/2010 |
| WO | 2010151684 | A1 | 12/2010 |
| WO | 2011003102 | A1 | 1/2011 |
| WO | 2011146387 | A1 | 11/2011 |
| WO | 2013028370 | A1 | 2/2013 |

* cited by examiner

SUIT FOR ATHLETIC ACTIVITIES

FIELD

The present invention relates to uniforms or suits for athletic competitions and other activities, such as speed skating events.

BACKGROUND

Racing competitions for human athletes, in particular speed skating competitions (e.g., at an elite level), typically include gear designed for optimum performance by the athlete. Suits and other apparel associated with a particular racing sport are designed to reduce drag on the athlete. For example, in speed skating sports as well as other sports in which an athlete is moving at a rapid speed within an environment, suits are typically worn by athletes that adhere tightly and conform to the profile of an athlete's body so as to provide a streamlined contour as the athlete moves through the air or other fluid environment of a racing competition.

When performing at an ultra-elite level (e.g., competitions between the best and fastest athletes world-wide, such as an Olympic event), any feature that can reduce wind resistance and drag reduction on an athlete can enhance the athlete's performance in a racing event (e.g., increasing the athlete's speed and performance during the event, reducing the athlete's event time by fractions of seconds, etc.).

Accordingly, it would be desirable to provide a racing suit that enhances drag reduction when worn by an athlete so as to improve the athlete's performance in a racing event.

SUMMARY

An article of apparel for athletic activity for moving through fluid (e.g., air) at a predetermined velocity is provided. Portions of the article of apparel are selectively modified to provide the garment with a desired aerodynamic profile. Specifically, various turbulator structures are incorporated into the garment at selected locations. Each turbulator structure is effective to generate a predetermined amount of turbulence within the boundary layer of the fluid in the immediate vicinity of the garment (bounding) surface.

In an embodiment, the garment includes a plurality of turbulator structures, each generating different levels of turbulence. Turbulator structures include a textile with a structure that provides a roughened exterior surface, a laminated textile with a generally smooth surface that includes an array of rounded and/or elongated protrusions, or a combination thereof. With this configuration, the overall aerodynamic profile of the article of apparel may be tuned for a particular sporting activity. For example, the garment may be configured such that the turbulators work in concert to reduce the drag experienced by the garment (and thus the user) during athletic activity.

BRIEF DESCRIPTION OF THE DRAWINGS

Like reference numerals have been used to identify like elements throughout this disclosure.

DETAILED DESCRIPTION

Figure 1:
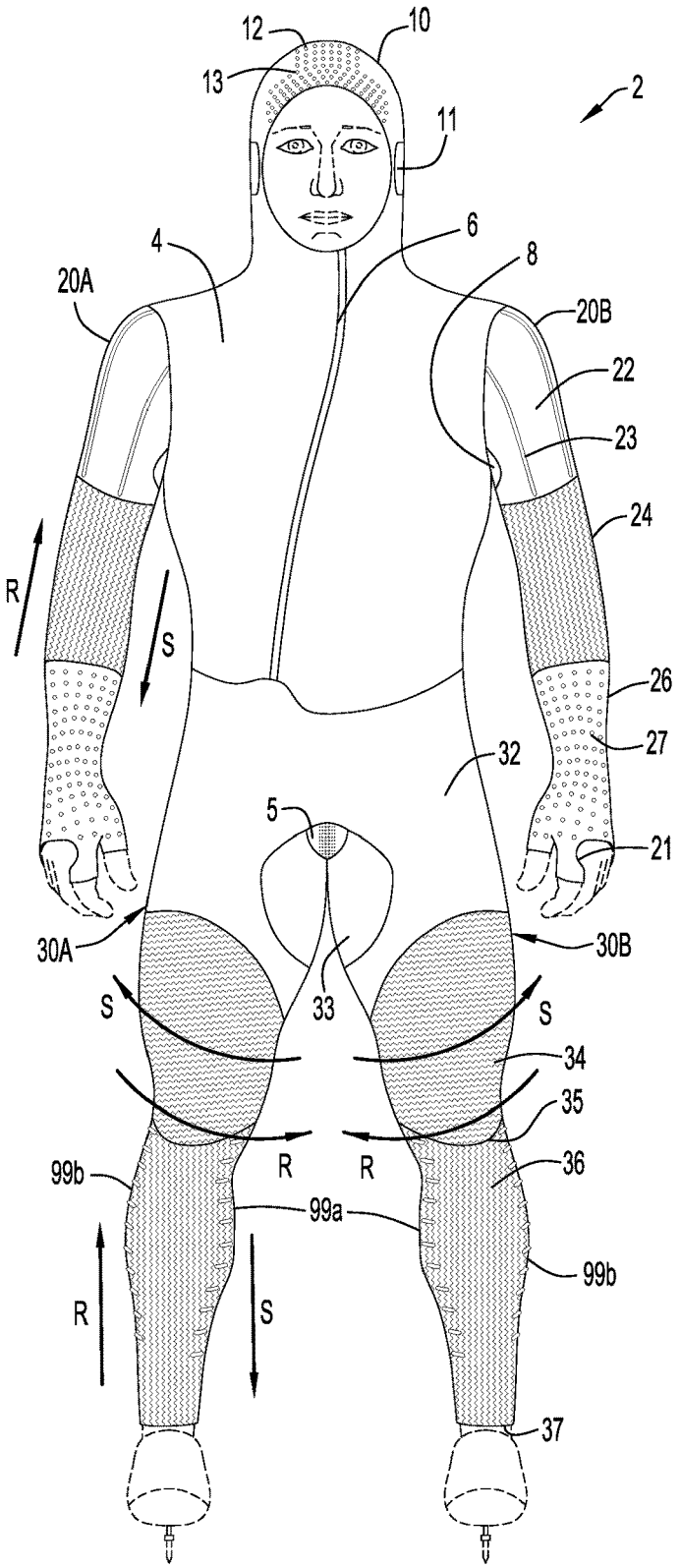
FIG. 1 is a front view of an example embodiment of a speed skating suit worn by a user in accordance with the present invention.

As described herein, an article of apparel for athletic activities may be in the form of a suit including a main body or torso, arm sleeves, leg sleeves, and a hood extending from the torso section. The different portions or sections of the suit are suitably dimensioned to respectively conform to a human user's torso, head, arms and legs when worn by the user engaging in athletic activities. The suit includes wind resistance or drag reduction features provided at suitable locations along exterior surface portions of the suit to enhance user performance during the activities.

As described herein, the drag reduction features implemented for the suit include different materials provided at different locations along the suit, where the different materials include smooth surface regions, in which air or fluid flow substantially conforms to the contour of the material surface, and uneven surface regions, in which the uneven surface regions comprise roughened sections and sections that include protrusions (e.g., elongated ridge structures or vanes, protruding bumps or dots, etc.) that are strategically located to generate turbulent fluid flows within a boundary layer along the contour of the material surface resulting in fluid flow following the profile of the material surface. The combination of smooth and uneven surface regions at selected locations of the suit enhances overall drag reduction caused by air and/or other fluids through which the user is moving during an athletic activity.

The challenges with reducing drag to enhance aerodynamic performance of an object moving within a fluid medium (e.g., air) can be complicated and depend upon a number of variables including, without limitation, speed of the object as it flows through the fluid medium, exterior profile of the object (including contour and degree of smoothness/roughness of the object surface), type of fluid medium, and orientation of the object as it travels through the fluid medium. The fluid flow patterns around an object can be characterized in terms of its Reynolds number, Re, where Re is a dimensionless value that is a function of surface dimension(s) of the object (e.g., a surface dimension of the object about which the fluid medium flows), the velocity of the object within a fluid medium, and the density and viscosity of the fluid medium. The Reynolds number has the following formula:

$$Re=(\rho v L)/\mu$$

where:

$\rho$=density of fluid medium;

$v$=mean velocity of object relative to fluid medium;

$L$=traveled length of the fluid medium around object; and $\mu$=viscosity of fluid medium.

Fluid flowing within a boundary layer (i.e., within the immediate vicinity of the object surface) around an object can be defined as laminar or turbulent based upon the Re value associated with the conditions of the object moving within the fluid medium. In particular, laminar flow occurs at low Re values, where viscous forces tend to dominate and there is a smooth, constant fluid motion of the fluid medium within the boundary layer around the object. In contrast, turbulent flow occurs at high Reynolds numbers where inertial forces tend to dominate and produce chaotic eddies, vortices and other flow instabilities for the fluid medium within the boundary layer.

When considering fluid flow around a rounded object (e.g., a cylinder or a sphere, which have contours similar or analogous to arms, legs, torso and/or a head of a person), laminar flow of the fluid medium within a boundary layer around the object does not tend to follow the surface of the object but instead tends to separate from the boundary layer so as to increase drag on the object moving through the fluid medium. In contrast, turbulent flow of the fluid medium within the boundary layer around the object tends to follow the object surface contour thus reducing drag on the object as it moves through the fluid medium. Generally, when relative velocity between the object and fluid medium is very high, fluid flow around the object tends to be turbulent while a relative velocity that is very low tends to result in laminar fluid flow around the object.

Depending upon speeds of a user wearing an article of apparel in accordance with the present invention, where the user is traveling through a fluid medium such as air, certain speeds of the user (in combination with the other factors associated with Re) can result in a critical or transition range between laminar and turbulent flow of fluid around the user. For example, a speed skater wearing apparel in accordance with the present invention may travel within a typical air environment at speeds ranging from about 20 miles per hour (MPH) to about 40 MPH (e.g., 30 MPH), and these speeds are within a velocity range where fluid flows around at least some portions of the user's body may transition between laminar and turbulent. In accordance with the invention, by increasing the surface roughness of certain body portions of the suit, fluid flows that might otherwise be laminar will transition to turbulent within the boundary layer at the surfaces of such body portions which results in a further overall drag reduction (i.e., enhanced aerodynamic properties imparted) for the user moving through the fluid medium. In particular, in accordance with embodiments of the present invention, certain body portions of the suit (e.g., lower and intermediate arm portions, lower and intermediate leg portions) having smaller cross-sectional dimensions in relation to other body portions (e.g., main trunk or torso) are also provided with uneven and/or roughened surfaces to enhance aerodynamic properties at such smaller cross-sectional body portions by transitioning the flow regime from laminar to turbulent along their surfaces.

Figure 2:
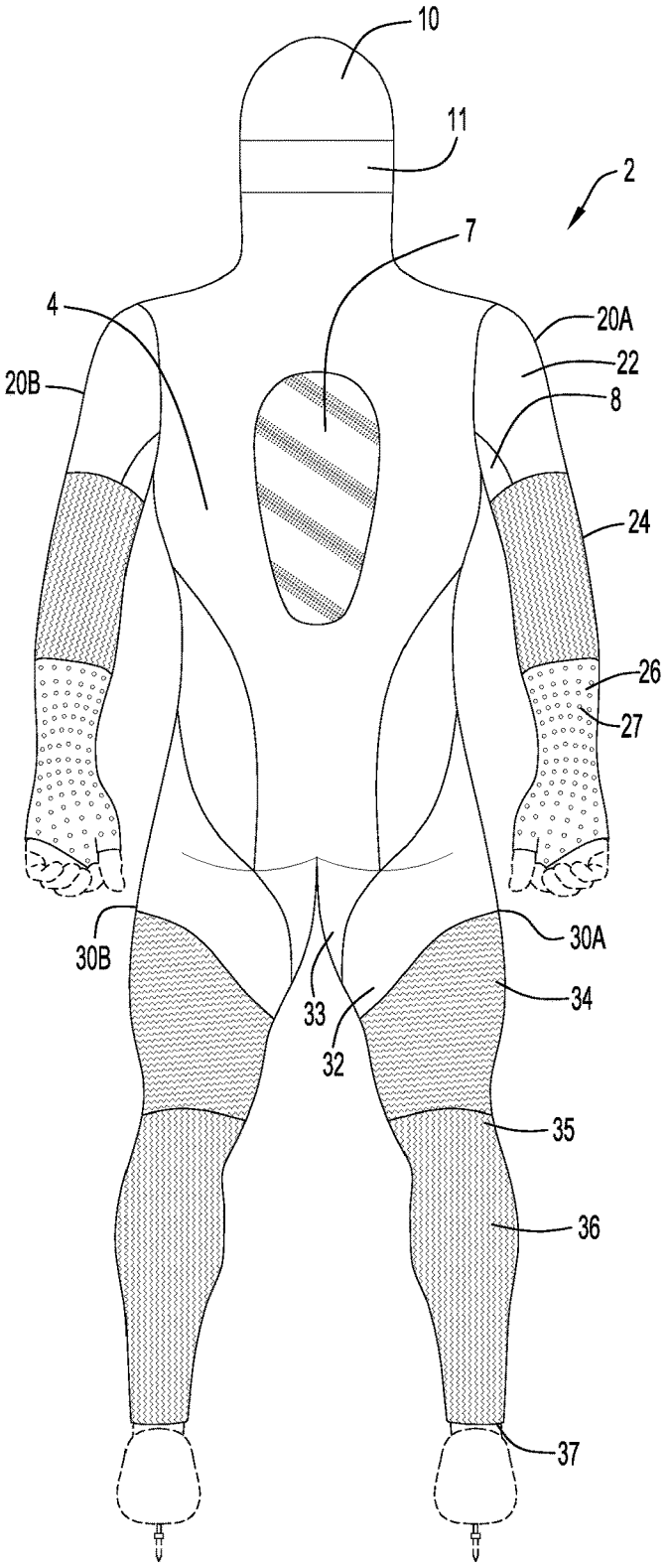
FIG. 2 is a rear view of the suit worn by the user of FIG. 1.
Figure 3:
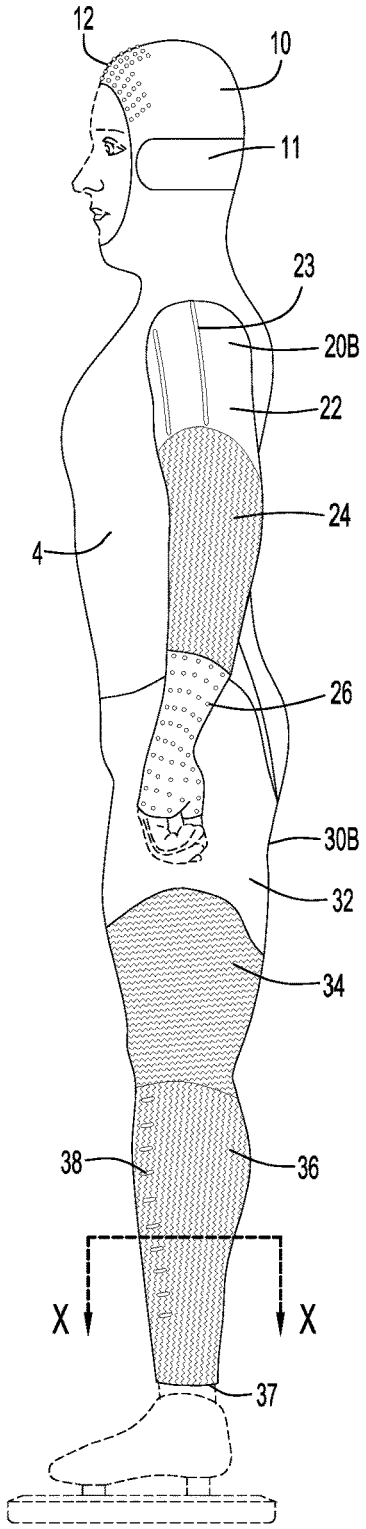
FIG. 3 is a side view of the suit worn by the user of FIG. 1.

An example embodiment of an article of apparel in accordance with the present invention is described with reference to FIGS. 1-15. As illustrated, the article of apparel is in the form of a resilient suit such as a speed skating suit. However, the present invention is not limited to use in speed skating environments but instead can be implemented for use in other contexts to enhance speed and performance of an athlete moving through air or some other fluid. Referring first to FIGS. 1-3, the speed skating suit 2 includes a main body or torso 4, a head covering 10, a first or right arm sleeve 20A, a second or left arm sleeve 20B, a first or right leg sleeve 30A, and a second or left leg sleeve 30B. The hood 10; arm sleeves 20A, 20B; and leg sleeves 30A, 30B are coupled with the torso 4 in a suitable alignment and suitably dimensioned so as to fit comfortably over while conforming to corresponding portions of the user's body (e.g., the user's head, arms and legs as can be seen in the figures).

As illustrated, each arm sleeve 20A, 20B terminates in a glove-like configuration that extends over portions of the digits of the user's hand while including one or more openings that allow exposure of the terminal end(s) of one or more digits of the user's hand. For example, as shown in the figures, each arm sleeve 20A, 20B includes a terminal end 21 with three openings configured to expose some or all of the user's thumb and fingers (where the user's thumb extends through a first opening of the terminal end, the user's forefinger extends through a second opening of the terminal end, and the remaining fingers of the user extend through a third opening of the terminal end). Thus, the suit 2 covers a significant portion of the user's body (as shown in FIGS. 1 and 2), leaving only portions of the user's hands, feet and face exposed.

The article of apparel (i.e., each section 4, 10, 20A, 20B, 30A, 30B) is generally formed of a resilient textile operable to conform to the contours of the user's body. That is, the sections of the suit 2 can be constructed of any suitable fabric or other materials that have elastic and body conforming characteristics as well as other aerodynamic characteristics as described herein. In particular, some or all of the suit sections 4, 10, 20A, 20B, 30A, 30B can be formed, at least in part, with resilient or elastic knitted, woven or nonwoven fabrics comprising one or more (e.g., a blend of) synthetic fibers, where the synthetic fibers can comprise one or more types of polyester-polyurethane copolymers (also referred to as "spandex"), one or more types of nylon (polyamide) polymers, one or more types of polyesters (e.g., polyethylene terephthalate, polybutylene terephthalate, etc.), one or more types of polyolefins, one or more types of polyurethanes, and combinations thereof. Suit sections can further comprise a single fabric layer or a plurality of layers combined via any suitable process (e.g., stitching, adhesion bonding, etc.). In an embodiment, two-way or four-way stretch fabric is used.

A suitable fastener 6 is provided for the suit 2 that extends from an upper portion of the torso 4 near the hood 10 to a lower portion of the torso 4 near a crotch 5 (i.e., the section of the suit 2 that defines a joint between torso 4 and leg sleeves 30A and 30B) so as to facilitate separation of left and right portions of the torso 4 when a user is putting on or taking off the suit 2. The fastener 6 is depicted in the figures as a zipper structure, where opening of the zipper (i.e., moving the zipper toward the crotch 5) allows for separation of the left and right portions of the torso 4 while closing of the zipper (i.e., moving the zipper toward the hood 10) joins the left and right portions of the torso 4 together. The zipper can be configured such that, in the closed position, the zipper is slightly offset (i.e., to one side) of the user's throat. The upper end of the zipper mechanism may include a fabric garaged secured over the termination point of the zipper to protect the user's throat and prevent discomfort during use.

When worn, the suit 2 provides a generally contoured fit over portions of the user's body. In particular, the torso 4 covers the user's torso or main body portion, and the hood 10 provides a covering for a portion of the user's head, including the portions of the user's head including hair and the user's ears, while leaving the user's face including chin and, optionally, a part of the user's neck exposed. Each leg sleeve 30A, 30B extends over a corresponding leg of the user from the user's trunk to a location proximate the user's ankle. Each arm sleeve 20A, 20B extends over a corresponding arm of the user from the user's trunk to the user's corresponding hand. Different sections of the suit 2 can be secured to other portions of the suit to form an integral unit in any suitable manner (e.g., via stitching between two or more fabric portions, via adhesive bonding between two or more portions, etc.).

As described herein, the each section of the suit 2 can be constructed so as to exhibit different types of aerodynamic characteristics along its exterior surface. In an embodiment, at least a portion of the suit is formed of a textile that generates an aerodynamic property. The term aerodynamic property refers to the properties of airflow along the surface (e.g., within a boundary layer along the surface) of the textile (e.g., to affect laminar and/or turbulent flow) and associated drag (e.g., reduction of form drag, interference drag, and/or skin friction). Typically, this may be achieved by providing a textile with a specific structure (e.g., particular knit configuration) and/or by modifying a base textile to alter its normal aerodynamic properties.

Specifically, the textile forming the suit 2 may be configured to disrupt, to a predetermined degree, the boundary layer—the layer of fluid (air) in contact with the garment surface (called the bounding surface) so as to enhance the potential for turbulent flow of air over the fabric surface (particularly when the user is moving at velocities in which the flow may be approaching or in transition between laminar and turbulent flows). In particular, when considering portions of the user's body as analogous to cylindrical objects for purposes of analyzing fluid flows around such objects (where the surface or "skin" of each body portion is about the same level of roughness), fluid flow around smaller diameter body portions (e.g., portions of arms and legs) may be laminar (i.e., have a smaller Re value) in relation to other body portions having larger diameters (e.g., the user's torso) at a particular velocity of the user within air or other fluid medium that may be at a critical transition region between laminar and turbulent flow. However, it has been determined in accordance with the present invention that providing certain smaller diameter body portions of the suit with a greater surface roughness in relation to larger diameter body portions of the suit results in an overall enhancement in the aerodynamic properties of the suit by transitioning flows of air over such smaller diameter body portions from laminar to turbulent during movement of the suit wearing user at certain velocities.

For example, some of the suit sections 4, 10, 20A, 20B, 30A, 30C (or portions of each section) can be constructed to have relatively smooth exterior surface features with low surface friction or skin friction, while other sections of the suit (or portions thereof) can be constructed to have uneven exterior surface features that increase the surface friction or skin friction at such uneven surfaces and making such uneven exterior surfaces rougher (or have a greater roughness) in relation to the relatively smooth exterior surfaces. In other words, an exterior surface portion feature of the suit categorized as "rough" in relation to another exterior surface portion feature categorized as "smooth" means that the rough surface portion feature exhibits a larger or greater surface friction or surface roughness for a fluid traversing the suit and being subjected to this rough surface portion feature in relation to a smooth surface portion feature of the suit. The suit sections 4, 10, 20A, 20B, 30A, 30C (or portions thereof) may work in concert with one another to generate the overall aerodynamic profile of the suit. Accordingly, the placement at different locations of different surface features along the suit enhances drag reduction experienced by the user when moving through an air-filled environment at speeds experienced during athletic performance.

The torso 4 generally covers the trunk of the user. In an embodiment, the torso includes a generally smooth surface lacking a turbulator structure as defined herein. In the example embodiment of FIGS. 1-15, a significant portion of the torso 4 is constructed of laminated fabric, i.e., a knitted or woven fabric including a blend of polyester and spandex (e.g., a knitted blend of about 88% by weight polyester and about 12% by weight spandex) with a thin, continuous film of polyurethane (PU) on its exterior surface. The PU laminate layer possesses a smooth exterior surface. Accordingly, the torso 4 has a surface friction or skin friction and a surface roughness that is smaller or less than surface friction and surface roughness characteristics of uneven (rougher) surface regions of the suit as described herein. In particular, due to the size of the torso 4 (i.e., the torso 4 is greater in diameter than the arm sleeves 20A, 20B and leg sleeves 30A, 30B), the torso surface can be maintained smooth via the PU laminate while ensuring that fluid flows around the torso tend toward being turbulent within a critical transition flow regime at certain velocities at which the user is moving through the air. Similarly, the proximal (upper) areas of the leg sleeves 30A, 30B may be formed of PU-laminated fabric (discussed in greater detail, below).

Figure 9:
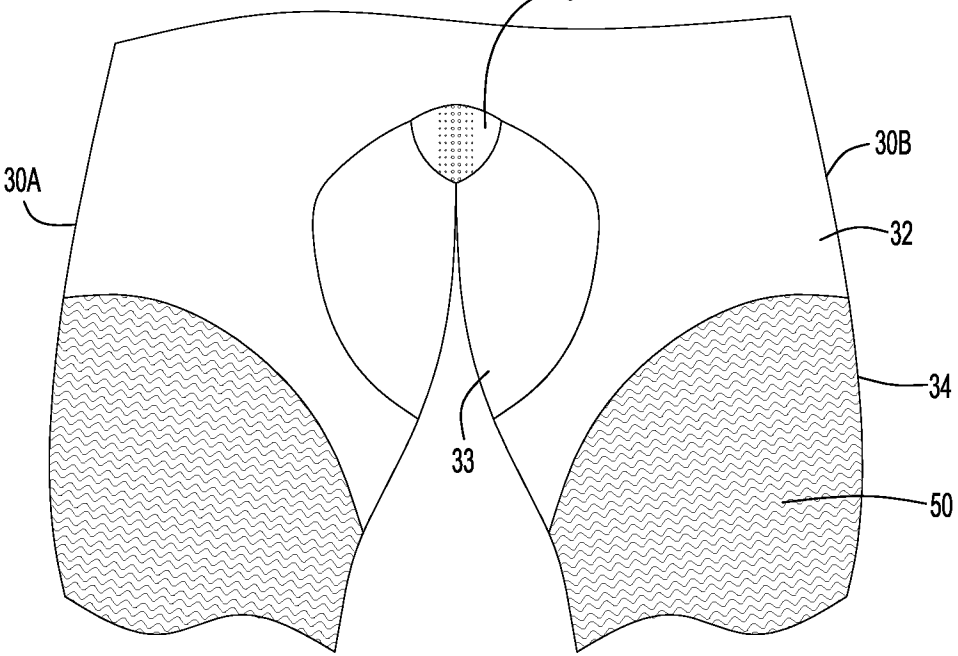
FIG. 9 is a partial view of the suit worn by the user of FIG. 1 including a view of the crotch region defining the join between the torso section and leg sections.
Figure 8:
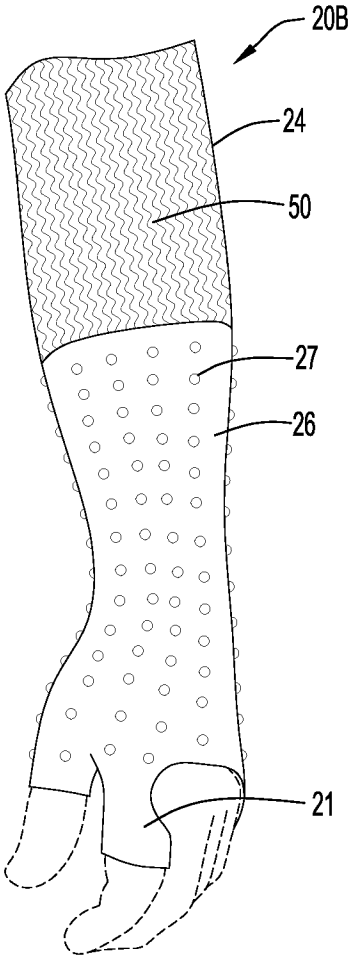
FIG. 8 is a partial view of the suit worn by the user of FIG. 1 including a front view of an arm section with a roughened section and a raised dot section.
Figure 14:
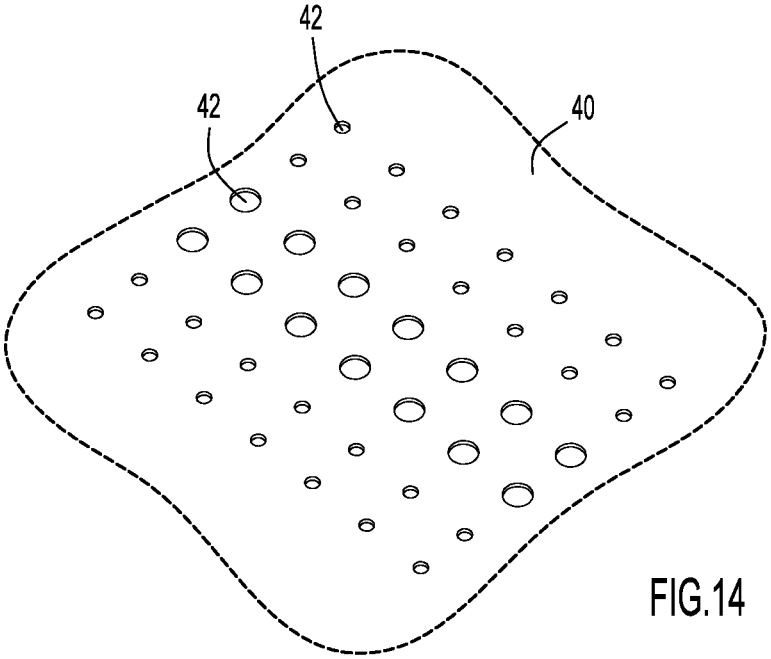
FIG. 14 is a partial view of permeable fabric material provided at different locations for the suit of FIG. 1.

The PU layer permits little or relatively no air to permeate this layer (i.e., the PU layer is substantially air impermeable or non-breathable with the air). While this is helpful to enhance drag reduction, it also can result in overheating by the user wearing the suit during vigorous activities (e.g., competing in a racing event). Accordingly, it may be desirable to provide suitable air venting within the suit worn by the user. For example, air venting can be provided within the suit at or near one or more portions of the torso 4. Referring to FIGS. 1, 2 and 9, air venting is provided at a back region 7 located along the back side of the suit 2 and extending in a lengthwise direction of the torso 4 that corresponds with a portion of the suit wearing user's spine, and at the crotch 5 defined at the joint between each leg sleeve 30A and 30B and the torso 4. Each of the regions 5 and 7 is formed of a suitable elastic material (such as a fabric comprising polyester and spandex and further includes a plurality of openings or pores in a selected pattern or arrangement so as to permit breathability or air flow between the suit wearing user and the air environment surrounding the user. The pores within the regions 5 and 7 can be of any one or more suitable sizes and shapes as desired for achieving adequate venting and breathability within the suit 2 (e.g., to prevent overheating of the user when performing physical activities). An example embodiment of a material 40 suitable for forming regions 5 and 7 is depicted in FIG. 14, in which a series or pattern of different sized pores 42 are provided within the fabric 40 to facilitate air permeability at these regions within the suit 2.

The head covering 10 may be in the form of a hood that covers the crown, back, nape, and ears of the user. The hood 10 is constructed of the same or similar materials as the torso 4, where a significant portion of the hood 10 is constructed of a knitted fabric comprising polyester and spandex (e.g., a knitted blend of about 88% polyester and about 12% spandex) and further includes a smooth exterior layer of PU formed as a laminate over the fabric. The hood 10 also includes a venting region 11 defined as an elongated band extending along a portion of the hood 10 that generally aligns with the back of the neck and extends from ear to ear. Venting region 11 can be constructed of a suitable material (e.g., a knitted blend of polyester and spandex), such as a material associated with the trademark HEAT GEAR and commercially available from Under Armour, Inc. (Maryland, USA), which, in addition to venting, permits or enhances transfer of sound to the user's ears when the hood 10 is worn over the user's head. Optionally, the venting region 11 can also be constructed with materials similar to those previously described herein in relation to regions 5 and 7 (e.g., to allow air permeability and breathability near the head or neck of the user).

Figure 5:
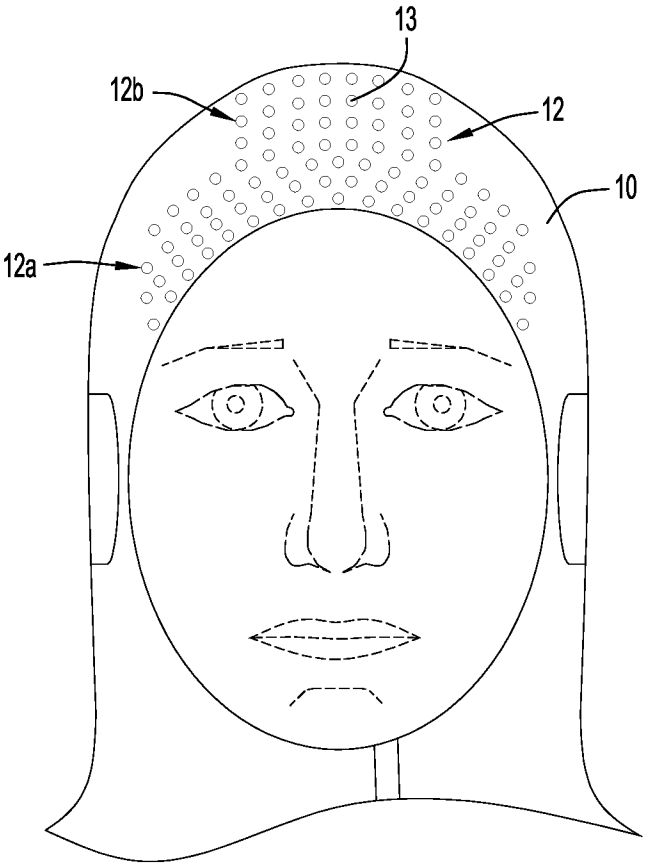
FIG. 5 is a partial view of the suit of FIG. 1 including the hood.
Figure 4:
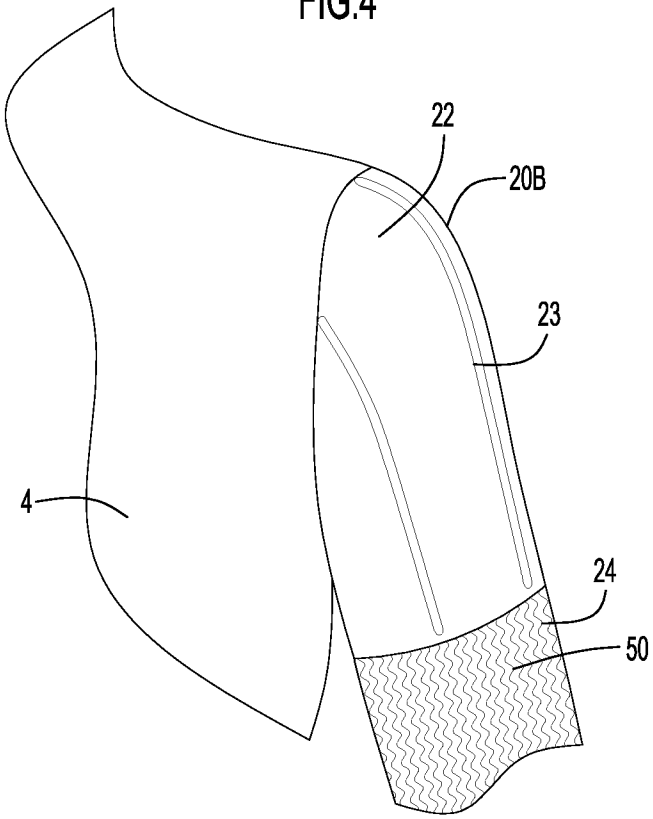
FIG. 4 is a partial view of the suit worn by the user of FIG. 1 including a top view of a portion of the torso section including a shoulder region with vanes aligned along the shoulder region.
Figure 6:
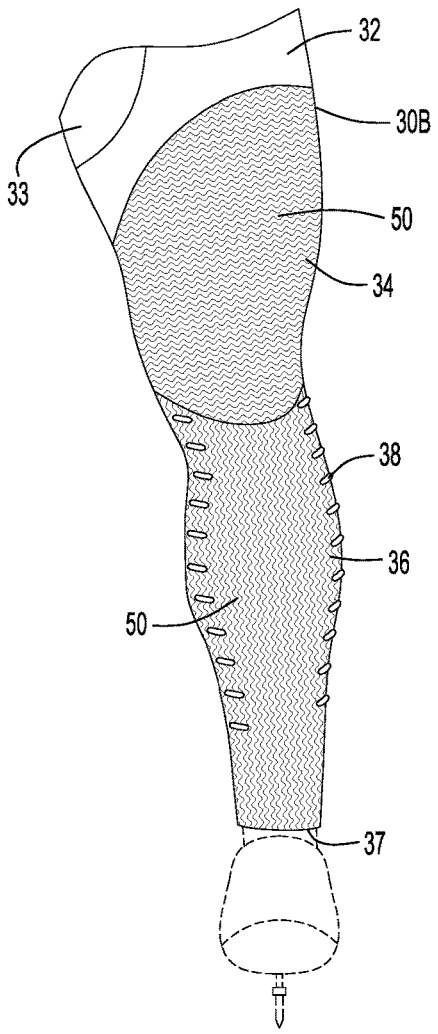
FIG. 6 is a partial view of the suit worn by the user of FIG. 1 including a front view of a leg section with different roughened sections forming the leg section.

The exterior surface of the hood 10 may further include a turbulator structure. Specifically, the hood 10 includes an uneven surface region 12 defined by a plurality of protruding elements or raised dots 13 aligned in relation to each other within the region 12 in a spaced pattern or array as described herein. Referring to FIG. 5, the region 12 of dots 13 comprises an elongated first band 12*a* that extends along an upper edge of the front portion of the hood 10, where the upper edge defines an opening that exposes the user's face when the hood is worn over the user's head. The first band 12*a* further extends in both directions along the upper edge of the hood 10 toward the user's ears and terminates at each end proximate the ends of venting region 11. The region 12 further comprises an elongated second band 12*b* that extends at about a central location from the first band so as to align along a central portion of the user's head extending from the user's forehead and terminating at about the top or crown of the user's head. Accordingly, region 12 possesses a general "T" shape with the upper portion of the "T" defined by the first band 12*a*, where the first band further has a greater lengthwise dimension than the second band 12*b*. However, the uneven surface region for the hood 10 can have any other suitable shape and/or be aligned in any other suitable manner that enhances drag reduction of air over the hood during operation for a particular environment.

Each region 12*a*, 12*b* may be formed via a flow molding process, whereby individual dots 13 are applied to the PU film in a predetermined pattern. The dots may possess any dimensions suitable for their described purpose (generate turbulence in fluid boundary layer). As shown, the dots 13 may possess a generally rounded or hemispherical shape with selected thickness and diameter dimensions. The dots 13 are arranged in an array having predetermined spaced alignments within each region 12*a*, 12*b*. An example embodiment of an arrangement of dots is described in further detail herein with reference to FIGS. 15A and 15B. With this configuration, the dots 13 form a turbulator structure, increasing the roughness (surface or skin friction) of the generally smooth surface of the laminated fabric. In operation, as a user moves along the playing field (e.g., the ice), fluid (air) travels along the hood surface, engaging the array of dots 13, which generates turbulence within the boundary layer of the fluid, reducing drag along the hood 10 of the suit 2.

Each arm sleeve 20A, 20B is a generally cylindrical tube tapering in diameter toward sleeve distal end. Each sleeve 20A, 20B includes an upper or proximal section 22 (which further covers a portion of the user's shoulder), a lower or distal section 26, and an intermediate section 24 disposed between the upper and lower arm sections. Each section may possess dimensions suitable for its described purpose, depending on the size of the user. In an embodiment, the length of the upper 22, intermediate 24, and lower 26 sections may be approximately 1:1:1.

Each sleeve section 22, 24, 26 may define a discrete airflow control area, i.e., an area that disrupts or causes turbulence along the interface between the fluid and the textile. Accordingly, each sleeve section 22, 24, 26 may possess a turbulator structure. The sleeve upper section 22 is formed of the smooth laminated fabric, described above. The exterior surface of the laminated fabric includes a plurality of elongated elements 23 (called trip wires or trips) oriented in predetermined positions along the circumference of the sleeve upper section 22. The trips 23 can be constructed of a polymer such as polyurethane. The trips may be applied via a flow molding process onto the PU film, may formed at the same time the PU film is formed (thus is integral with the film), or may be a separate element stitched or applied in any other suitable manner (e.g., via adhesive) to a layer of the laminated fabric. In any construction, each trip 23 forms a raised ridge along the surface of the laminated fabric.

The trips 23 possess predetermined dimensions and are angularly spaced from each other. As shown, each trip 23 is in the shape of a raised, elongated bar extending lengthwise along the sleeve upper section 22, from the shoulder area of the torso 4 to the sleeve intermediate section 24. Specifically, the trips 23 may be formed as cylindrically shaped bars or wires having diameters in the range of about 4.0 mm (i.e., the height of the vanes extending from the surface of the sleeve upper section 22 is about 4.0 mm). At least some of the trips 23 can be located along central and/or front portions of the sleeve upper section 22 (i.e., a front portion of the upper portion of the suit that is adjacent the front portion of the suit). Specifically, as illustrated in FIG. 1, the upper sleeve section 22 may include a first or lateral trip 23 and a second or medial trip 23 positioned on the dorsal side of the arm. The first and second trips 23 may be spaced, e.g., 8-10 cm apart. In an embodiment, the upper ends of the trips 23 may be approximately 10 cm apart, while the lower ends may be approximately 8 cm apart. In an example embodiment, the trips 23 have lengthwise dimensions of about 19-21 centimeters (cm). Accordingly, although the surface laminated fabric is smooth, the trips 23 cooperate to define a roughened area to affect fluid flow by, e.g., generating turbulence in the fluid boundary layer.

The intermediate section 24 of each arm sleeve 20A, 20B extends from the sleeve upper section 22 and is further suitably dimensioned so as to align and cover an intermediate portion of the user's arm (e.g., at a location proximate or slightly above the user's elbow) to a lower portion of the user's arm (e.g., at a location corresponding to a position below the user's elbow, but above the wrist). In an example embodiment, the sleeve intermediate section 24 possesses a length of about 20 cm.

The sleeve intermediate section may further include a turbulator structure that differs from those of the hood 10 and the sleeve upper section 22. Specifically, unlike the hood 10 and the sleeve upper section 22, which is formed of the laminated fabric having a smooth exterior surface, the sleeve intermediate portion 24 is formed of a textile having an uneven exterior surface area that defines a roughened surface region effective to affect air flow.

In an embodiment, the textile is a knitted or woven stretch fabric including, e.g., nylon and spandex in amounts of about 70% to about 80% (e.g., about 75%) by weight nylon and about 20% to about 30% (e.g., about 25%) by weight spandex. The structure of the fabric (e.g., the knit structure) is configured to provide directional tactile roughness, i.e., the exterior surface of the fabric exhibits a variance in surface properties, including surface friction or skin friction and surface roughness, based upon an alignment of the material in relation to a direction of its movement through a fluid medium. Specifically, the fabric construction generates a first tactile roughness in a first direction along the fabric surface, and a second tactile roughness in a second, opposite direction along the tactile surface. In addition, the construction provides dynamic roughness, where the degree of surface roughness or surface friction imparted by the fabric varies based upon a degree of elongation or stretching of the fabric. For example, the fabric may possess a first degree of roughness in its relaxed state and a second, lower degree of roughness in its stretched state (with the roughness generally decreasing with increasing stretch percentage).

Figure 10A:
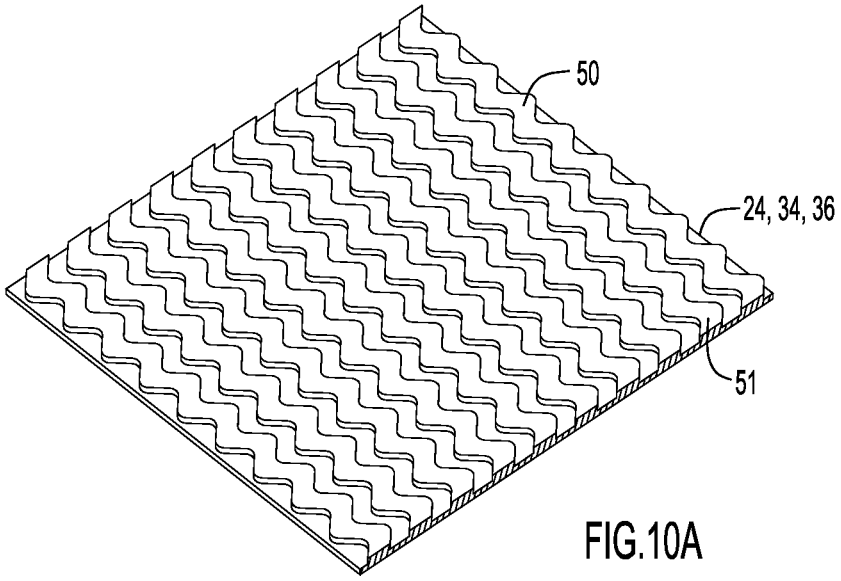
FIG. 10A is a view in plan of a portion of fabric material utilized for portions of the suit of FIG. 1, where the fabric material comprises an uneven surface of knitted yarns and/or fibers and that exhibits a rough, uneven surface in one direction and a relatively smooth surface in another direction along the surface.

For example, the knitted surface texture of the fabric material forming the sleeve intermediate section 24 (as well as the intermediate leg portion 34 and lower leg portion 36 for each leg sleeve 30A, 30B as described herein) can include rows or courses of fibers or yarns that are higher or extend further outward from the fabric surface in relation to adjacent rows or courses of fibers or yarns, thus yielding an undulating surface of yarns or fibers including "peaks" and "valleys" as depicted in FIG. 10A (where rows or courses 50 of yarns or fibers protrude outward and form peaks from the fabric surface in relation to adjacent rows or courses 51 or yarns or fibers forming valleys, thus defining an undulating or high/low/high/low arrangement of rows or courses). Each of the rows or courses 50, 51 of yarns or fibers forming the fabric material also extend in zig-zag or undulating pattern.

The physical characteristics of the fabric are such that the fabric exhibits different surface roughness and surface friction characteristics along different exterior surface dimensions (e.g., along length and width dimensions) of the fabric and even along the same dimension (e.g., along the length or along the width) but in opposing directions of the fabric. In an example embodiment, the physical characteristics of the fabric are such that the fabric generates the so-called shark skin effect, where the surface friction or surface roughness imparted to a fluid medium or object moving along one direction of the material is greater or more rough in relation to the surface friction or surface roughness imparted to the fluid medium or object moving along an opposing direction of the material.

Figure 11:
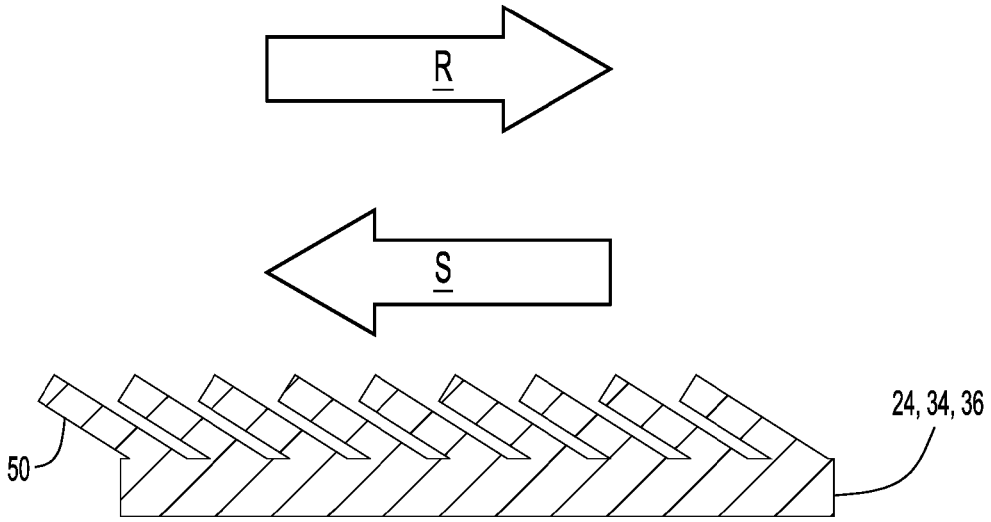
FIG. 11 is a magnified cross-sectional view of a portion of a fabric material of FIG. 10.
Figure 12:
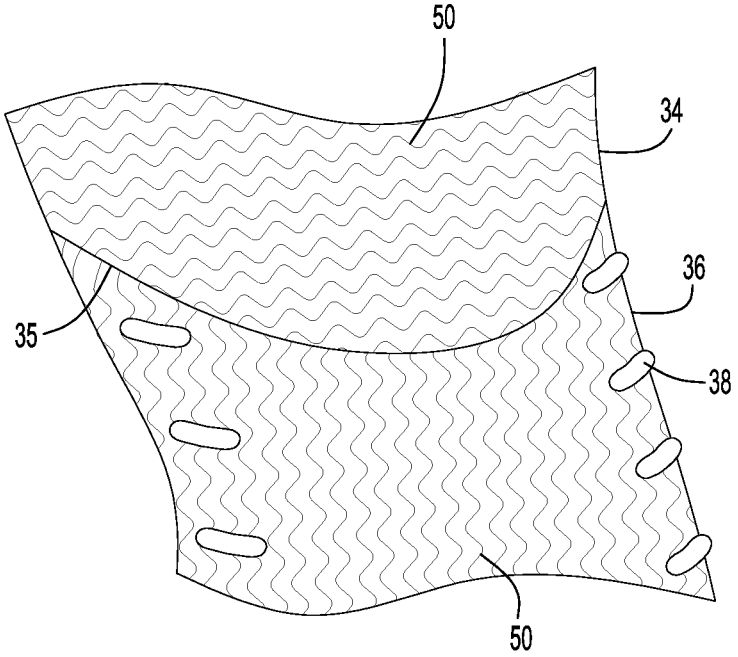
FIG. 12 is a magnified view of the joint between portions of a leg section of the suit of FIG. 1, where each of the portions comprise the fabric material as schematically depicted in FIGS. 10A and 11.

A magnified cross-sectional view of the fabric FIG. 10A is depicted in FIG. 11, where arrow R represents a rough direction along the fabric material, and arrow S represents a smooth direction along the fabric material. In particular, the alignment of certain courses or rows of fibers or yarns forming the knitted fabric (identified as rows 50) is such that an uneven, rough surface is defined in one direction along the fabric surface in a direction transverse the course or row pattern of the surface. Application of a force to the surface in a first direction, such as movement of an object or fluid (e.g., air) over the surface in the first or smooth direction (as shown by arrow S in FIG. 11), results in the object or fluid flow encountering a small amount of skin friction or surface friction. However, when the same force is applied to the surface in a second direction that opposes the first direction (as shown by arrow R in FIG. 11), the fabric surface exhibits a surface roughness and/or surface friction that is greater than the surface roughness and/or surface friction associated with the fabric surface for forces applied to it in the first direction (i.e., the surface roughness of the fabric material in the second or R direction is greater than the surface roughness of the fabric material in the first or S direction). As described herein, the uneven and rougher surface that is exhibited by the fabric material in the second or R direction causes a disruption in air/fluid flow over the surface in this direction so as to transition fluid flow from laminar to turbulent at a critical or transition Re value associated with the fabric material (e.g., when a user, such as a speed skater, wearing the suit is moving through air at speeds from about 20 MPH to about 40 MPH or greater). The R (rough) and S (smooth) directions of the fabric material for the intermediate portion 24 of each arm sleeve 20 (as well as for the intermediate portion 34 and lower portion 36 of each leg sleeve 30) are also shown in FIG. 1.

Referring back to FIG. 1, the orientation of the tactile directions is lengthwise, along the longitudinal axis of the sleeve 20A, 20B. Specifically, the fabric forming the sleeve intermediate section 24 is such that the rough direction (indicated by arrow R) extends in a lengthwise direction, upward along the arm (from the sleeve lower section 26 toward the sleeve upper section 22). The smooth direction (indicated by arrow S) for the arm sleeve intermediate section 24 is oriented downward, from the upper section 22 toward the arm sleeve lower section 26.

The arm sleeve lower section 26, covering the lower forearm and hand is formed of a knitted or woven textile having two or four way stretch capabilities. Unlike the fabric of the sleeve upper section, the fabric is not laminated. The sleeve lower section fabric further includes a turbulator structure on its exterior surface. The sleeve lower section 26 extends from the sleeve intermediate section 24 (e.g., at a location corresponding to a position below the user's elbow)

to the terminal end 21. In an example embodiment, the sleeve lower section 26 possesses a length of about 22 cm.

The fabric is provided with an uneven surface uneven surface via a dot array. Specifically, the sleeve lower section 26 includes a plurality of protrusions in the form of rounded elements or raised dots 27 having a generally hemispherical shape or configuration and selected thickness and diameter dimensions similar to the raised dots 13 formed at region 12 of the hood 10. The dot array spans the entire surface area (e.g., the entire circumferential periphery) of the sleeve lower section 26, including locations that extend to the finger/thumb openings at the terminal end 21, with the exception that the finger opening at the terminal end 21 corresponding with the user's index finger may not have any raised dots or protrusions.

Figure 15A:
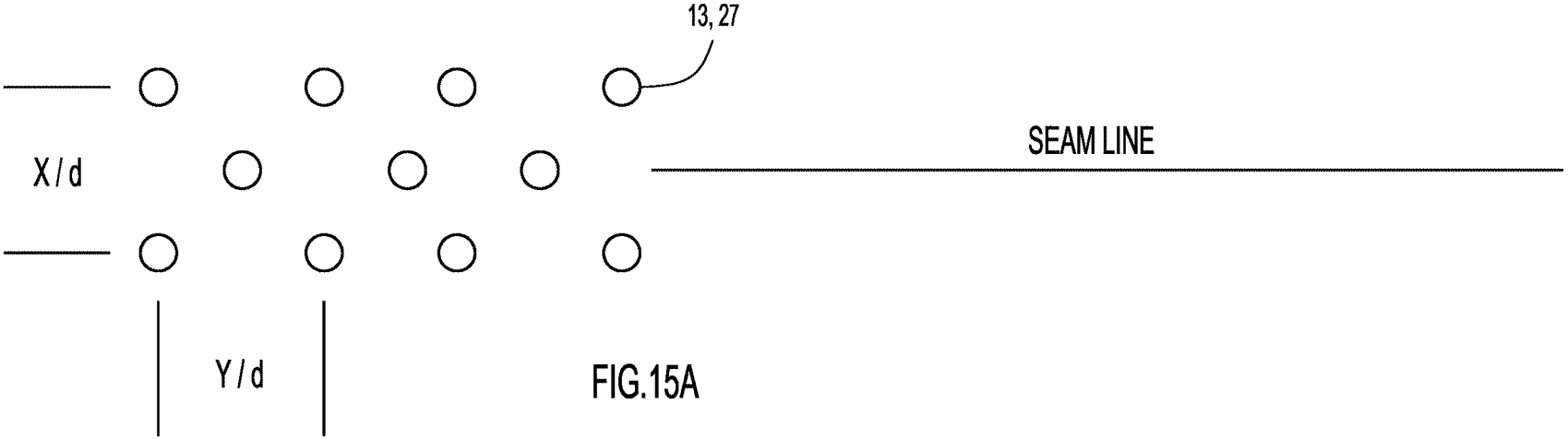
FIG. 15A is a view of a portion of a material utilized for portions of the suit of FIG. 1, where the material comprises a rough, uneven surface formed by a pattern or array of raised dots.

In an example embodiment depicted in FIG. 15A, the dots 27 can be spaced from each other along circumferential surface portions of the sleeve lower section 26 in a pattern or array of linear rows stacked in relation to each other such that dots in each row are slightly offset in relation to dots in an adjacent row. In particular, the dot pattern depicted in FIG. 15A is arranged in relation to a longitudinal seam line extending along sleeve 20A, 20B and/or along sleeve lower section 26. The X direction of the dot pattern is generally transverse (e.g., normal or perpendicular) to the seam line and a Y dimension is generally aligned with (e.g., parallel to) the seam line (the seam is general disposed on the palmar side of the sleeve). The seam line (and thus Y dimension) for the lower sleeve section 26 is aligned in the lengthwise direction of the arm (i.e., the seam line extends along the arm sleeves 20A, 20B in a direction between the user's hand and the user's elbow).

Figure 15B:
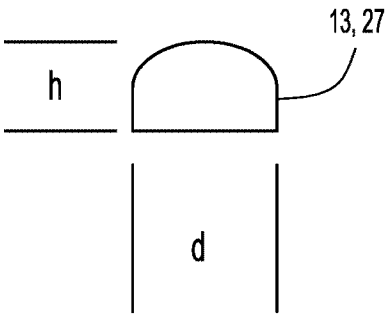
FIG. 15B is a view of a dot from the pattern of raised dots for the material of FIG. 15A.

Rows of consecutive or neighboring dots 27 aligned along the X dimension are spaced from each other a dimension X/d, while rows of consecutive or neighboring dots 13, 27 aligned along the Y dimension are spaced from each other a dimension Y/d. An example profile of each dot 13, 27 is depicted in FIG. 15B, which shows a height dimension H and a diameter (or cross-sectional dimension) D of the dot. In accordance with the present invention, patterns of dots can be provided such that dimension H has a value from about 0.015 inch to about 0.06 inch, dimension D has a value from about 0.06 inch to about 0.12 inch, the spacing in the X dimension or X/d has a value from about 2.5 to about 3.5 (distance between dots in the X dimension being from about 0.15 inch to about 0.42 inch), and the spacing in the Y dimension or Y/d has a value from about 2.5 to about 3.5 (distance between dots in the Y dimension being from about 0.15 inch to about 0.42 inch). In a preferred embodiment, the pattern of dots, as depicted in FIG. 15A, has a pattern or spacing along the seam line of the material with each dot having the following values: H is about 0.030 inch, D is about 0.12 inch, spacing between dots in a row aligned in the X dimension is about 0.42 inch (X/d is about 3.5), and spacing between dots in a row aligned in the Y dimension is about 0.36 inch (Y/d is about 3.0). In particular, it has been determined that the dot pattern alignment as depicted in FIG. 15A and the spacing and dimensions of dots as noted for the preferred embodiment provides effective aerodynamic properties (e.g., enhanced drag reduction) for the suit 2, particularly when combined with the other features of the suit as described herein.

As should be understood, while the specific orientation of sleeve dots 27 is discussed, it should be understood that the dot array in the region 12 of the hood 10 may possess a substantially similar layout, and each hood dot 13 may possess similar dimensions.

Referring, e.g., to FIGS. 1 and 2, an underarm or armpit region 8 is defined at the joint between each arm sleeve 20A, 20B and the torso 4. Each armpit region 8 can be constructed of a suitable material such as the same or similar material that forms the region 11 of hood section, or the same or similar material that forms crotch 5 and region 7.

Each leg sleeve 30A, 30B is a generally cylindrical tube extending distally from the torso 4, tapering in diameter toward sleeve distal end. Each leg sleeve 30A, 30B includes a proximal or upper leg section 32, a lower or distal leg section 36, and an intermediate leg section 34 disposed between the upper and lower sleeve sections. In an embodiment, the sleeve upper section 32 possesses a length of approximately 25 cm, the sleeve intermediate section 34 may possess a length of approximately 21 cm, and the sleeve lower section 36 may possess a length of approximately 36 cm.

The sleeve upper section 32 extends from the torso section 4 at the crotch 5 to the sleeve intermediate section 34 (e.g., at a suitable location corresponding with a position above the user's knee). Each sleeve upper section 32 includes a substantial portion formed of a material similar to the material forming the torso 4 (e.g., a laminated fabric comprising polyester and spandex and further including an exterior layer of TPU formed as a laminate over the fabric material). An inner thigh region 33 of the sleeve upper section 32 extends lengthwise between the crotch 5 and a location slightly above the intermediate section 34. Each inner thigh region 33 has a curved, semi-circular shape in the front portion of the suit 2 that corresponds with the opposing region 33 and is formed of a suitably slippery or low friction fabric material that reduces or eliminates friction between the two inner thigh regions 33 during athletic movements by the user (e.g., during rapid movements of the user's thighs in opposing directions when the user is engaging in a skating activity). The low friction area between the corresponding inner thigh regions 33 is such that the coefficient of friction due to contact between these two regions during user movements is low. In an example embodiment, the thigh regions 33 are formed of a suitably low friction material such as a reflective stretch overlay film formed of elastomeric polyurethane that is commercially available from Bemis Associates Inc. (Massachusetts, USA) under the tradenames RS3000 and OT-100RS.

The remaining sections of each leg sleeve 30A, 30B include the sleeve intermediate section 34 that extends from the sleeve upper section 32 at a location corresponding with a position above the user's knee to a position slightly below the user's knee (e.g., slightly below the user's knee cap), and a lower leg section 36 that extends from the sleeve intermediate section 34 (at a location that corresponds with being slightly below the user's knee cap) to a terminal end 37 of the leg sleeve 30A, 30B that corresponds with the user's ankle. An elastic seam 35 (e.g., a silicone elastic seam) is formed at the joint between the sleeve intermediate section 34 and the sleeve lower section 36 to hold the joint below the user's knee cap when the suit is worn by the user.

Each of the intermediate and lower sleeve sections 34, 36 include a turbulator structure to provide each section with an uneven surface region. In particular, each of the intermediate and lower sleeve sections 34, 36 is formed of the same type of uneven and roughened fabric material as the sleeve intermediate section 24 for each arm sleeve 20A, 20B. Specifically, each section 34, 36 may be formed of the fabric possessing directional and dynamic roughness as described above. By way of specific example, a knitted fabric having an uneven exterior surface that exhibits a variance in surface roughness and/or surface friction based upon an alignment of the material in relation to a direction of its movement through a fluid (e.g., air) medium may be utilized. Thus, each of the intermediate 34 and lower 36 sleeve sections (similar to each intermediate section 24 of the arm sleeve 20A, 20B) is formed of a fabric material having a configuration as depicted in the views of FIGS. 10A and 11, such that each section includes a rough direction (indicated by arrow R in FIG. 1) and a smooth direction (indicated by arrow S in FIG. 1) exhibited by the fabric material in relation to a direction of fluid flow over the fabric material.

However, the orientation of the fabric material for the sleeve intermediate section 34 is rotated transverse (e.g., about 90°) in relation to the orientation of the fabric forming the sleeve lower section 36 such that the rough and smooth directions for the leg sections 34, 36 are transverse (e.g., normal or perpendicular) to each other (as shown in FIGS. 1, 6, 7 and 12 by the orientation of rows or courses 50 of fibers or yarns for each leg section 34, 36). In particular, the rough and smooth directions R and S for the sleeve intermediate section 34 are directed circumferentially around (i.e., transverse a lengthwise dimension of each sleeve section) the user's thigh, whereas the rough and smooth directions R and S for the lower section 36 for each leg section 30 are directed along a lengthwise dimension of each leg section.

The fabric forming each sleeve lower section 36 is oriented within the suit 2 such that its rough direction R extends upward, away from the terminal end 37 of the leg sleeve 30 and toward the sleeve intermediate section 34, while smooth direction S extends away from the intermediate section 34 and toward the terminal end 37 of the leg sleeve 30.

The fabric can be oriented in the same or different manner for each sleeve intermediate section 34, so as to provide smooth and rough directions S and R for each intermediate section that match or are opposing (i.e., mirror images) of each other. In an example embodiment, the fabric material forming the sleeve intermediate section 34 of the left leg sleeve 30B can be oriented in a different manner (e.g., oriented 180°) in relation to the fabric forming the intermediate section 34 of the of the right leg sleeve 30A such that the rough directions R for the left and right leg sleeves oppose each other as do the smooth directions S. In the example embodiment depicted in FIG. 1, the intermediate section 34 of the right leg sleeve 30A has its smooth direction S oriented in a clockwise direction around the user's thigh (when viewing the user in an upright position as shown in FIG. 1). Stated another way, the smooth direction runs in the lateral direction across the front of the leg. The rough direction R, moreover, extends in a counter-clockwise direction around the user's thigh (i.e., the rough direction runs medially across the front of the leg).

In contrast, the intermediate section 34 of the left leg sleeve 30B has a rough direction R extending in a clockwise direction around the user's thigh and a smooth direction S extending in a counter-clockwise direction around the user's thigh (i.e., the smooth direction runs laterally across the front of the leg and the rough direction runs medially across the front of the leg).

Figure 10B:
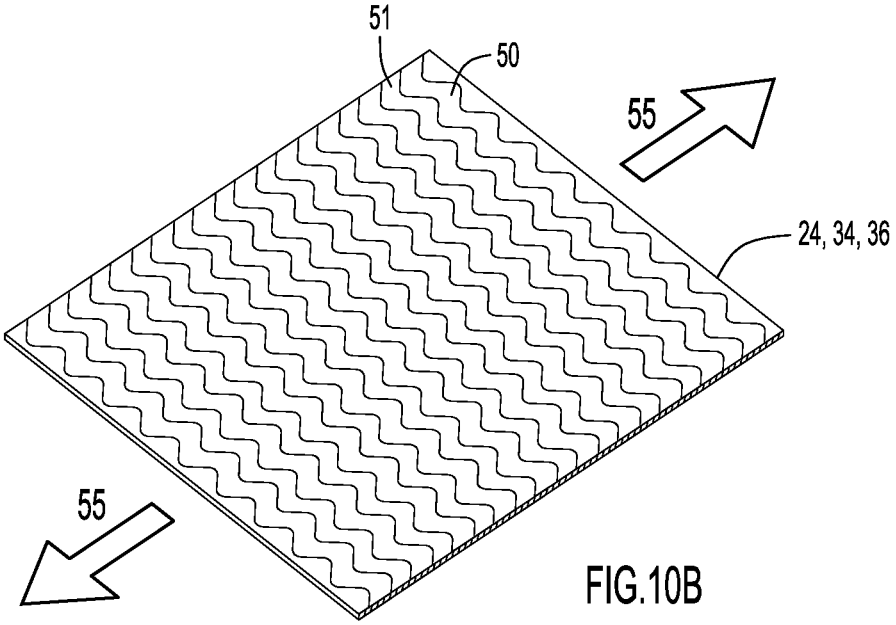
FIG. 10B is a view of the portion of fabric material as depicted in FIG. 10A stretched in a direction transverse the wavy courses or rows forming raised peaks of the fabric material.

A dynamic roughness feature of the fabric forming the intermediate sections 24 of the arm sleeves 20A, 20B, as well as the intermediate 34 and lower 36 sections of the leg sleeves 30A, 30B is described with reference to FIG. 10B. As shown in FIG. 10B, when the fabric forming these sections is stretched in directions transverse (e.g., normal or perpendicular) to the directions of the rows or courses 50 of knitted yarns or fibers (shown by the opposing arrows 55 in FIG. 10B), the rows or courses 50 forming the "peaks" of the fabric are diminished in height due to the stretching of the fabric material which results in a reduction of the degree of roughness in the rough direction R along the fabric material. Due to the alignment of the rows or courses 50 within the fabric material forming the intermediate section 34 of each leg sleeve 30A, 30B, movement of a user's leg that involves bending at the knee during activities results in stretching of the fabric for the intermediate section 34 of each leg sleeve 30A, 30B, which, in turn, reduces the degree of roughness at these portions. This can be beneficial and enhance aerodynamic performance of the suit 2, particularly for leg movements associated with sports such as speed skating.

Each sleeve lower section 36 includes a turbulator structure to affect the fluid boundary layer. Specifically, the sleeve lower section includes protruding elements or vanes located at various positions along exterior surfaces of the lower section. The elements are in the form of raised and elongated ridges having a lengthwise dimension and are oriented so as to extend transverse (e.g., normal or perpendicular) to a lengthwise dimension or axis of the sleeve lower section 36. The vanes 38 can be formed, e.g., of a polymer such a polyurethane (PU). The vanes may be deposited individually onto the fabric via flow molding.

Figure 7:
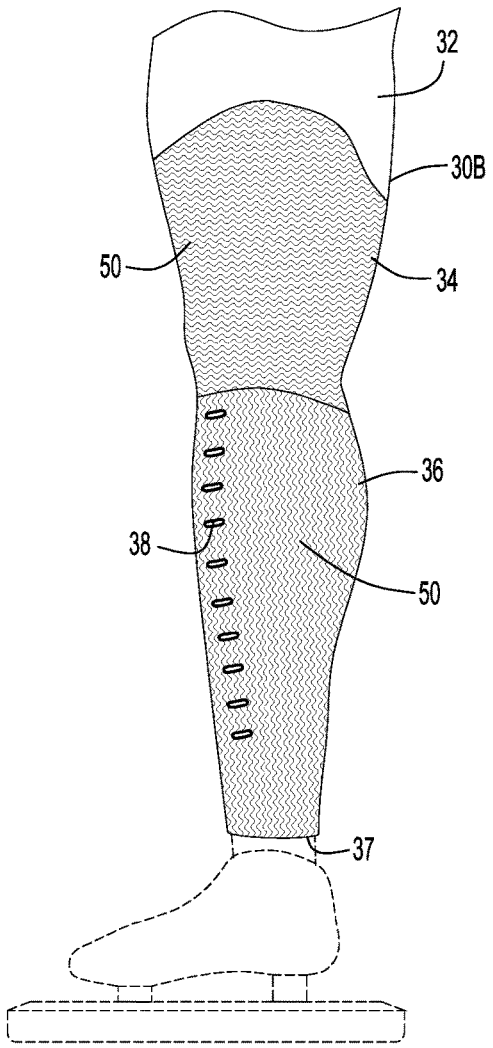
FIG. 7 is a partial view of the suit worn by the user of FIG. 1 including a side view of the leg section.

As shown in FIG. 7, the vanes 38 are aligned in spaced relationships with each other and in a linear stacked relationship along the lengthwise direction (e.g., substantially along the length) of the sleeve lower section 36. A row of stacked vanes 38 extending the lengthwise direction of the sleeve lower section 36 are provided along each of the medial side 99*a* (i.e., inner leg sleeve) and the lateral side 99*b* (i.e., outer leg sleeve) side of each sleeve lower section 36.

Figure 13:
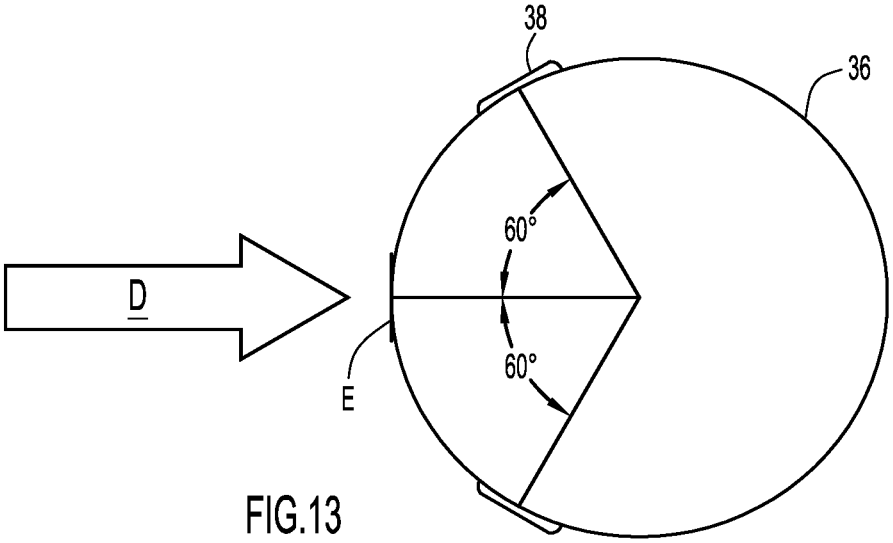
FIG. 13 is a cross-sectional view of a portion of a leg section of the suit of FIG. 1 taken along line X-X of FIG. 3 and showing how two rows of vanes are arranged along the portion of the leg section and oriented at a selected angle from a line normal or perpendicular to a central axis of the portion of the leg section.

Each of the vanes 38 is oriented a suitable distance from a central location at the front or most forward position, also referred to as the leading edge, of the sleeve lower section 36, where the leading edge of the lower section corresponds with a central portion of the user's shin. A cross-sectional view of the sleeve lower section 36 showing the orientation of the vanes 38 in relation to the leading edge and a flow direction D of air impinging the lower section when the user is moving a leg is depicted in FIG. 13. In particular, the leading edge E of the sleeve lower section 36 intersects or is tangent with a point on the surface of the lower section, and a radial line L extending from a center of the sleeve lower section intersects the leading edge E at its tangent point. The sleeve lower section 36 is oriented in a cross-flow in relation to the flow direction D (where the lengthwise axis of the lower section is normal or perpendicular to the flow direction), which defines a sweep angle of the lower section in relation to the flow direction as 90°. When the sleeve lower section 36 is oriented such that its lengthwise axis is parallel to the flow direction D, the sweep angle is 0°.

The spacing of rows of vanes 38 can be at any suitable angle from line L. In particular, it has been determined that spacing of the rows of vanes 38 at a spacing angle of about 60° (as shown in FIG. 13) to about 75°, where the spacing angle is defined as the angle between line L and a line intersecting a portion (e.g., a central portion) of a vane 38, results in a significant drag reduction effect in relation to air flows impinging the lower section 36 of the leg sleeve 30 at a variety of different orientations or sweep angles of the lower section 36 in relation to the air flow direction.

In particular, tests were conducted on a 3.5 inch cylinder disposed within a wind tunnel, where the cylinder closely represented the dimensions of a user's leg corresponding with the lower section 36, in which vanes were aligned along the cylinder in a similar manner as vanes 38 along the lower section 36 (i.e., in the manner as depicted in the figures). The vanes were spaced between about 0.5 inch to about 1 inch apart in each row of vanes, and such spacing was determined to produce effective results in drag reduction tests. Increasing the spacing between vanes in a row above 1 inch would likely reduce the effectiveness of the drag reduction effect of the vanes, while decreasing the spacing between vanes below 0.5 inch may enhance the drag reduction effectiveness for a particular application. In an example embodiment, the vertical spacing between vanes along the lower section of each leg sleeve is between about 0.5 inch and about 1 inch.

A maximum drag reduction effectiveness of the vanes for a given cylindrical structure (e.g., a structure that models or is similar to the lower leg portion of a human) can be determined, for certain applications, to be about equal to the total area of the vane projected in an axial direction per distance along the cylindrical surface and diameter of cylindrical surface. In particular, if there is one vane per inch, and each vane has a projected area of 0.04 $in^2$, and further the cylindrical surface is 3.5 inches in diameter (about the diameter of a user's lower leg portion at or near the shin), a maximum drag reduction effectiveness can be determined as $0.04/(3.5\times1)=0.00164$ relative vane area. The projected area of the vane would be equal to the product of the height and length of the vane.

The vanes 38 may possess a variety of different geometric configurations; moreover, the vanes may and be aligned in different positions in relation to other vanes (e.g., vanes arranged parallel to each other in a row, vanes arranged non-parallel to each other in a row, some vanes arranged in both parallel and non-parallel orientations in relation to other vanes in a row, etc.). For example, the vanes 38 in the figures have a generally rectangular configuration. The vanes can further have tapered or angled end surfaces that form a relatively thin or sharp edge oriented toward the leading edge of the sleeve lower section 36. In addition, the vanes 38 can have upper flat surfaces or, alternatively upper angled surfaces that terminate at a relatively thin or sharp top edge. Some example dimensions for vanes effective in enhancing drag reduction at the lower sections 36 can have dimensions of about 0.08 inch in height, about 0.5 inch in length and about 0.14 inch in width at the base of a vane. However, vanes 38 having other dimensions are also effective for enhancing drag reduction along the leg sections in particular applications.

The drag reduction tests performed for the vanes arranged on a cylindrical surface indicated that, while one row of vanes 38 (i.e., vanes on only one side of the cylindrical surface) is effective in enhancing drag reduction, providing two rows of vanes with each row provided on opposing sides of the cylindrical surface (at sweep angles of the cylindrical structure in relation to the airflow direction ranging from about 30° to about 75°) is even more effective in reducing drag.

In the tests conducted for cylindrical structures having a configuration as depicted in FIG. 13, a reduction in drag was achieved for cylinder sweep angles between about 30° and about 70°, with maximum effectiveness at sweep angles of about 45°. This was determined to be the case for different air flow velocities used to test the cylindrical structures. The sweep angles providing maximum effectiveness correspond with the sweep angles associated with a user's shin when the user is engaging in speed skating or other related sport activities (e.g., running).

Figure 16A:
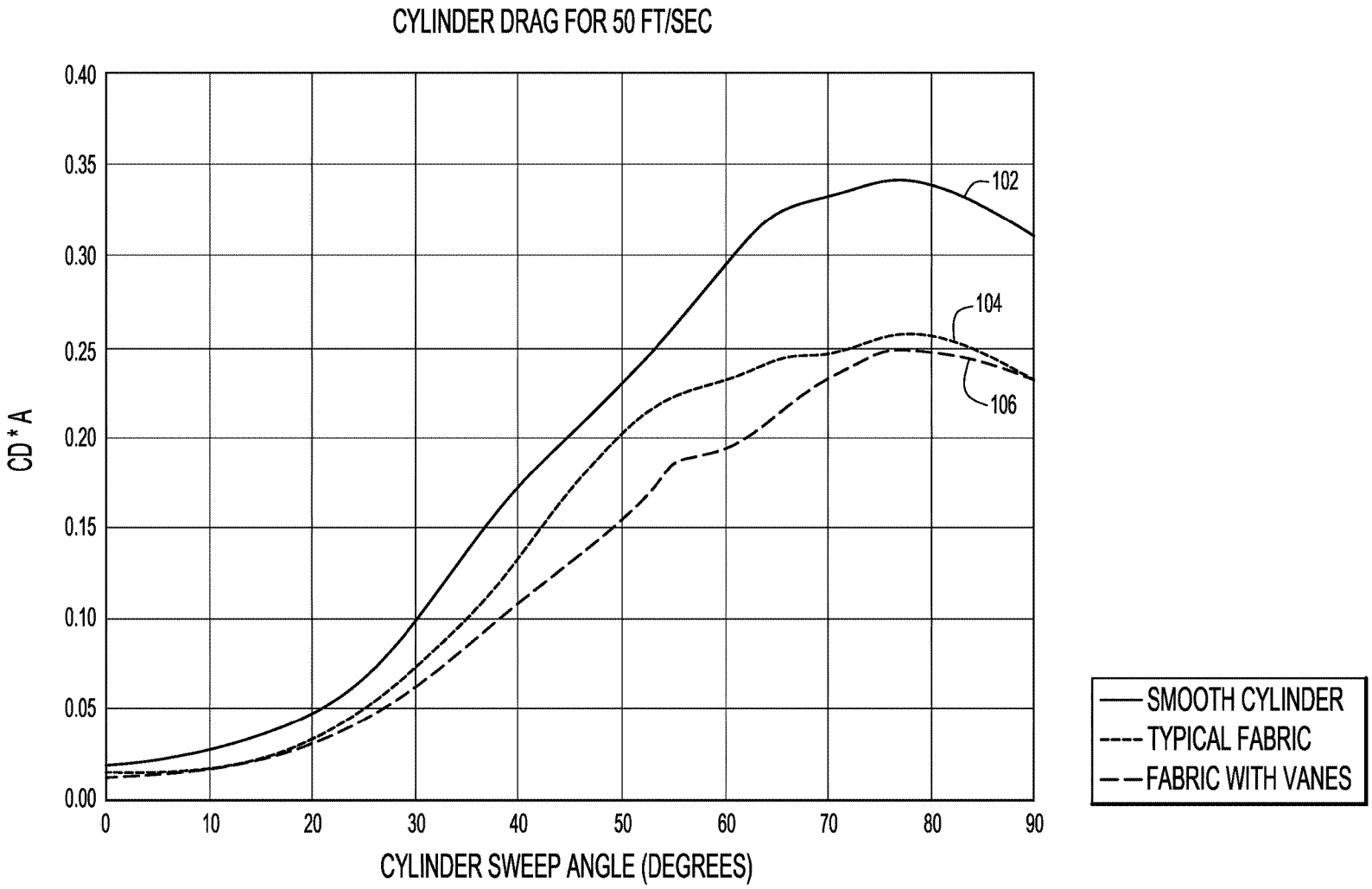
FIGS. 16A-16C are data plots depicting cylinder sweep angle vs. cylinder drag for drag reduction tests within a wind tunnel for cylinders having different degrees of roughness along the cylinder exterior surface.
Figure 16B:
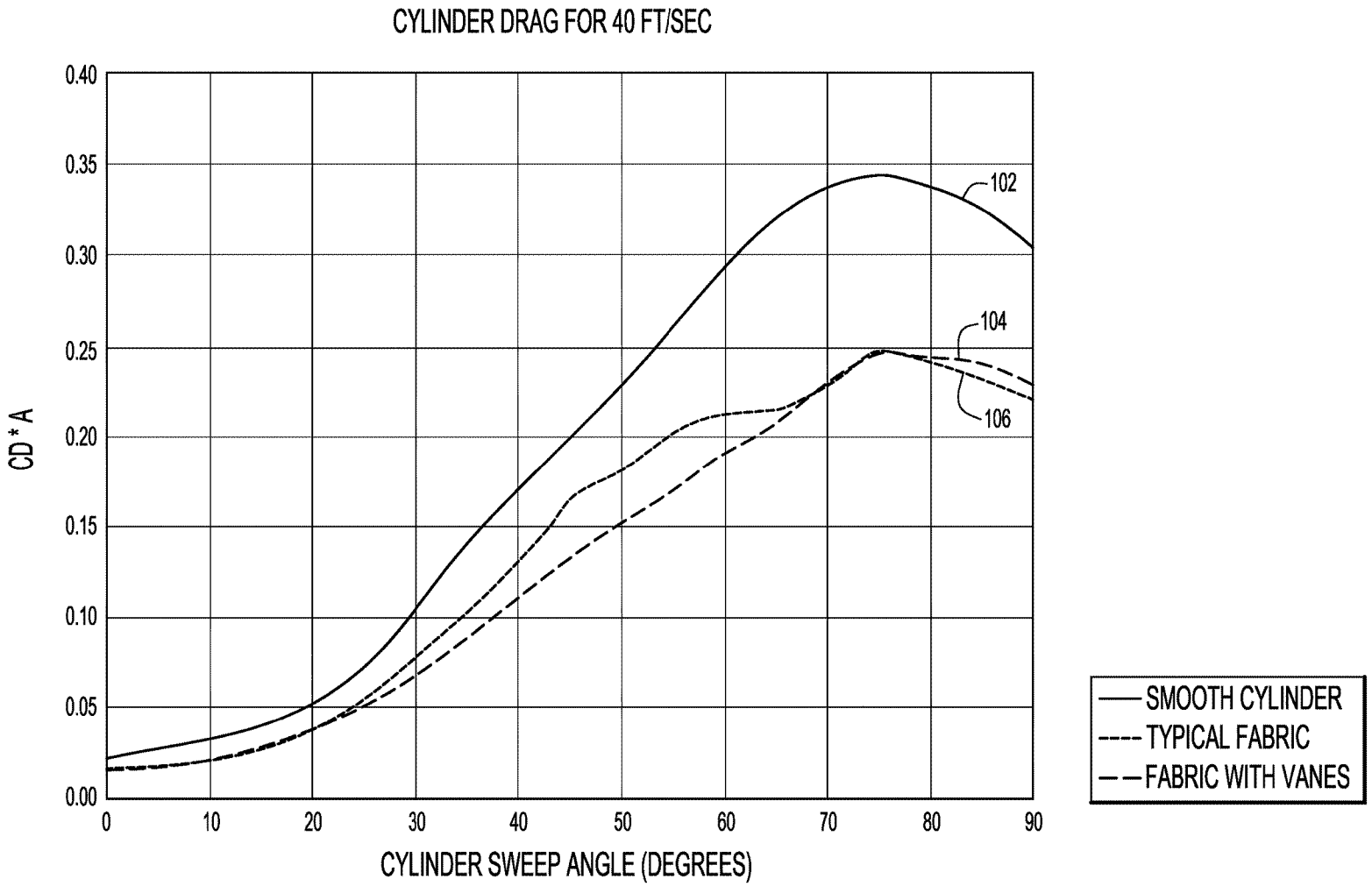
Figure 16C:
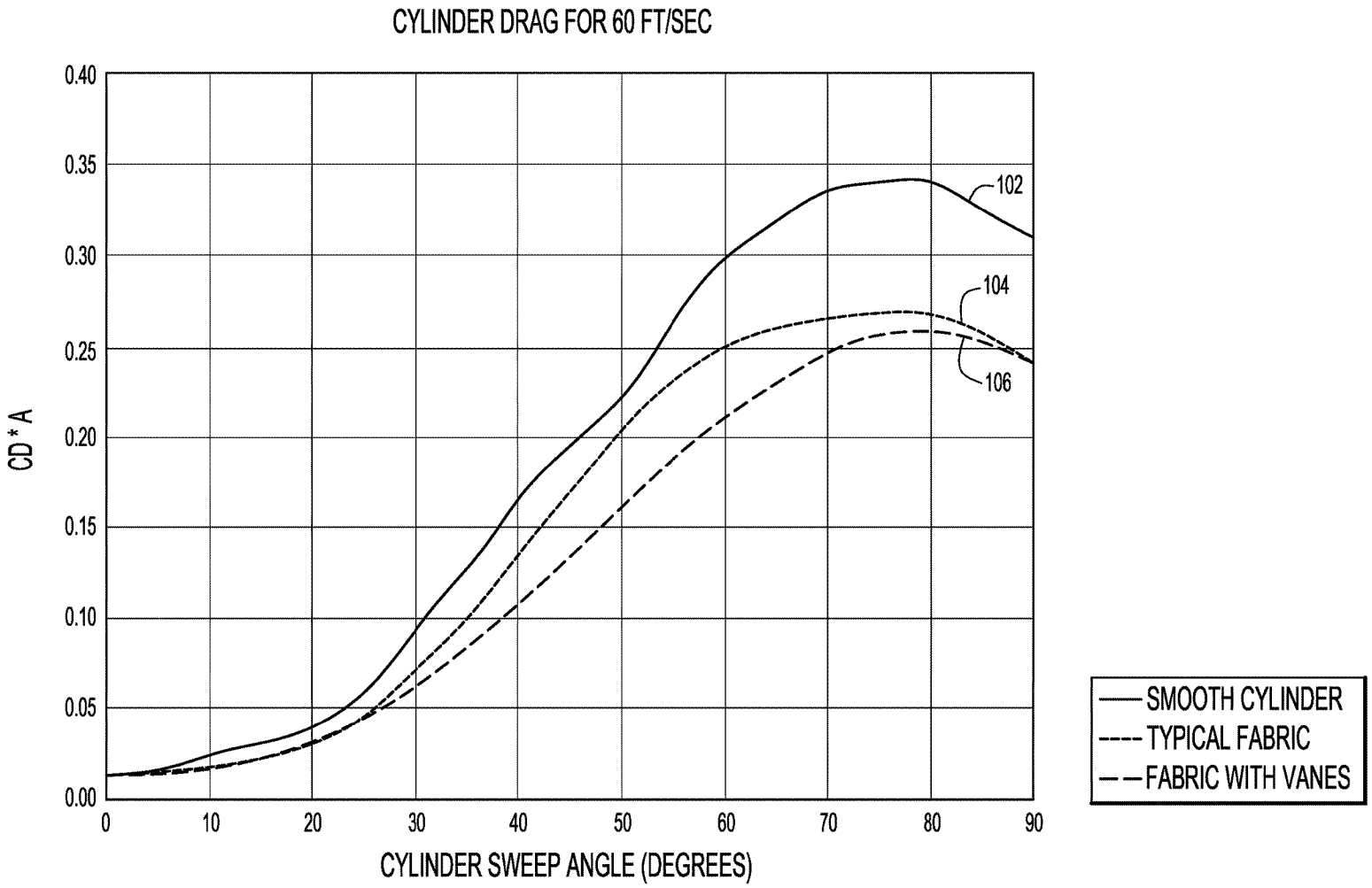

Referring to FIGS. 16A-16C, tests were conducted at three different air flow velocities for three different types of cylindrical structures, a smooth cylinder (represented as plot 102), a cylinder covered with a relatively smooth fabric (e.g., a fabric comprising nylon and/or spandex, represented as plot 104), and a cylinder with the same relatively smooth fabric and further including two rows of vanes aligned in the manner as depicted in FIG. 13 (represented as plot 106). Each cylinder was tested within the wind tunnel at wind velocities of 50 ft/sec (FIG. 16A), 40 ft/sec (FIG. 16B) and 60 ft/sec (FIG. 16C) and at a variety of sweep angles. The plots of FIGS. 16A-16C depict the effect on cylinder drag based upon sweep angle of the cylindrical structure to the wind flow direction. It is noted that the wind speeds in this range represent a range of speeds associated with world class speed skaters.

As can be seen from the plots depicted in each of FIGS. 16A-16C, there is a close similarity in drag for all three plots for sweep angles less than 30° (mainly aligned with the wind flow direction) and sweep angles greater than 70° (close to cross flow). However, in the range between these two extremes, a significantly lower drag is achieved for the cylindrical fabric structure including vanes (plot 106) in relation to the other two structures (plots 102 and 104). The test results demonstrate the enhanced drag reducing effect of vanes (or other protrusions) provided at the locations and alignments along the leg sleeve 30A, 30B for the suit 2 according to embodiments of the present invention.

The test results particularly show that providing vanes on the suit in the lower leg section 36 of the leg section (e.g., in a region of the user's calves) is highly effective since the average sweep angle encountered at this portion of the suit 2 during user movements in relation to wind directions is in the range of vane effectiveness (i.e., within the 30° to 70° sweep angle range). However, vanes 38 are also effective in reducing drag at other locations of the suit 2, such as the vanes 23 at the upper section 22 of each arm sleeve 20 and/or other locations along the suit depending upon a particular application and a user's movements when engaging in an activity while wearing the suit. One factor that is associated with the effectiveness in a location of vanes on a suit depending upon a time dependent orientation of the vane to a direction of air flow around the portion of the suit to which the vanes are located. Other factors may also be applicable depending upon the type of sporting activity in which the suit is to be utilized.

While the vanes 38 at the lower sections 36 of the leg sleeves 30A, 30B and the trips 23 at the upper sections 22 of the arm sleeves 20A, 20B have been determined to enhance aerodynamic performance of the suit 2 in accordance with embodiments to the present invention, other portions of the suit that would tend to rotate during use to much greater degrees in relation to the airflow direction would not benefit from utilizing vanes. For example, the user's forearms and wrists tend to move to a much greater degree in different rotational directions in relation to the direction of airflow during movements of the user (e.g., arm movements by a speed skater or other athlete when skating or running) such that providing vanes along the lower portions of the arm sleeves would not be as effective as along the lower sections of the leg sleeves. Accordingly, the lower sections of the arm sleeves utilize dot patterns to generate a turbulent fluid flow and reduce drag instead of vanes.

Thus, varying the locations and/or types of uneven surfaces (e.g., roughened surfaces and/or surfaces including one or more protrusions) on the suit 2 in accordance with embodiments of the present invention enhances drag reduction of the suit for different types of movements and different athletic activities performed by the user wearing the suit. While the suit 2 is particularly useful for athletes performing speed skating competitions, other embodiments of a suit in accordance with the present invention can be implemented for use for other athletic activities, in particular activities in which a user is moving rapidly through an air or other fluid environment.

In particular, one or more arm sections, one or more leg sections and/or the hood sections can include at least one exterior surface region that is uneven and has at least one of a different surface friction property and a different surface roughness property in relation to at least one exterior surface region of the torso section. For example, an arm section, a leg section and/or a hood section can include an exterior surface region that is uneven and has at least one of an increased surface friction (as measured, e.g., by a coefficient of friction at the surface region) and an increased surface roughness (as measured, e.g., by one or more characteristics of the surface texture, surface topology, surface irregularities, etc.) in relation to at least one exterior surface region of the torso section. Since a user, during an exercise or athletic activity (e.g., speed skating), is moving his or her limbs and even his or her head to assist in engaging in forward (or backward) movements, providing different surface regions having different smooth or uneven surface characteristics as selected locations can enhance the overall aerodynamic performance of the suit by reducing drag at such surface regions.

While the invention has been described in detail and with reference to specific embodiments thereof, it will be apparent to one skilled in the art that various changes and modifications can be made therein without departing from the spirit and scope thereof. For example, the materials utilized to form the various sections of the suit 2 include suitable lightweight and sufficiently elastic materials that are stretchable when worn by the user so as to form a tight or snug (i.e., not loose) fit over the user's body. As described herein, some of the materials are air permeable or breathable, while other materials are less air permeable or breathable. Different materials are also provided at different locations of the suit 2 exhibit different degrees of surface friction or skin friction and also different degrees of drag reduction in relation to air (or other fluids) when the user worn suit is moved through the air (or other fluid) environment.

The size dimensions of the suit 2 will vary based upon the size and configuration of the user so as to ensure a close and snug fit (e.g., a compression fit) is achieved between each suit and an individual user's body without limiting movement of body parts by the user. Further, while different materials are provided to form different portions of the suit, the suit can be formed as a single, integral (i.e., one piece) unit.

It is noted that, while is zipper is illustrated for the fastener 6, the fastener can be also implemented in any other suitable manner (e.g., utilizing button fasteners, snap fasteners, Velcro or hook-and-loop fasteners, etc.).

Any suitable spacing(s) provided between raised dots 13, 27, and can further vary in dimensional sizes (e.g., vary in thicknesses and/or diameter dimensions). While the dots 13, 27 are depicted in the figures as being hemispherical in shape, any other suitable shapes and sizes of protrusions can also be provided to enhance drag reduction of the suit at or near the user's head for particular embodiments. The dots may possess any dimensions suitable for their described purpose (generate turbulence in fluid boundary layer), and may be oriented in any pattern suitable for this purpose.

The dots 27 can be arranged in any suitable alignments or patterns along each lower portion 26, with any suitable spacing(s) provided between raised dots, and can further vary in dimensional sizes (e.g., vary in thicknesses and/or diameter dimensions). The raised dots or protrusions of each lower portion 26, while being depicted in the figures as hemispherical in shape, can alternatively have any other suitable shapes and sizes and further be aligned in any different types of selected patterns along the surface area of the lower portion 26.

Any suitable number of trips 23 (e.g., one, two, three or more) can be provided at each arm sleeve upper portion 22, where the vanes can further vary in dimensions (e.g., any suitable length, height, thickness, diameter or cross-sectional dimension), shapes, spacing from one or more other vanes, etc. However, the trips 23 can be located at a variety of different locations along each shoulder region of the suit so as to enhance drag reduction over the shoulder regions during use of the suit.

The directional fabric forming the arm sleeve intermediate section 24, the leg sleeve intermediate section 34, and the leg sleeve lower section 36 can be oriented differently (e.g., rotated any selected angle in relation to the orientation depicted in the figures) to achieve a desired aerodynamic effect for a particular application.

The polymer structures may be applied by flow molding. In one type of conventional flow molding process, a die is provided with a recess receiving liquid polymer. After the recess is filled with the liquefied plastic material, the fabric layer is placed in a center area and extends over the recess to have its peripheral zone in contact with the liquefied material. The material is then cured. Other flow molding techniques are discussed in U.S. Pat. Nos. 4,268,238, 4,441,876, 4,524,037 and 4,851,167. Along with flow molding, other techniques such as screen printing may be utilized to form the trips, vanes, and dots.

Furthermore, locations of smooth and uneven surface regions for the suit can be placed at a variety of different locations and have a variety of different configurations. For example, uneven surface regions can include any forms and types of bumps, protrusions, elongated ridges or vanes, or any other suitable types of structures that extend transversely from a surface of the suit at one or more selected locations along the suit. The roughened regions can be formed of any suitable types of knitted, woven, nonwoven fabrics and/or any other types of materials that exhibit different surface friction characteristics in relation to a direction of air or fluid flow over the suit surface comprising such roughened regions.

While the suit design is described herein in relation to environments involving airflow around the user, it is noted that the present invention is not limited to enhancing drag reduction for a suit worn by a user when moving through air, but instead is also applicable to other fluids (e.g., other gases or liquids).

Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

What is claimed:

1. A suit wearable by a human user, the suit comprising:

a torso section;

two arm sections extending from an upper portion of the torso section; and two leg sections extending from a lower portion of the torso section;

wherein:

at least one of an arm section and a leg section includes at least one exterior surface region that is uneven and has a different surface friction property in relation to at least one exterior surface region of the torso section;

the at least one exterior surface region comprises a roughened material that exhibits a variance in surface roughness or surface friction based upon a direction of movement of a fluid along the roughened material; and the roughened material is configured such that the surface roughness or surface friction of the roughened material is greater along a rough direction of the roughened material in relation to a smooth direction of the roughened material that opposes the rough direction.

2. The suit of claim 1, further comprising:

a hood section extending from the torso section, the hood section being oriented and configured as part of the suit so as to receive the user's head when the suit is worn by the user.

3. The suit of claim 1, wherein the roughened material comprises a textile material having an uneven exterior surface formed by rows or courses of fibers or yarns, at least some of the rows or courses of fibers or yarns extend further outward from an exterior surface of the roughened material in relation to other rows or courses of fibers or yarns.

4. The suit of claim 3, wherein the roughened material is further configured to exhibit a variance in surface roughness or surface friction in response to a degree of stretching or elongation applied to the roughened material.

5. The suit of claim 4, wherein the textile material comprises nylon and copolymers of polyester and polyurethane.

6. The suit of claim 1, wherein the roughened material is provided along a portion of each arm section.

7. The suit of claim 1, wherein the roughened material is provided along one or more portions of each leg section.

8. The suit of claim 7, wherein each leg section includes a lower leg portion that extends below the user's knee when the suit is worn by the user and an upper leg portion that extends above the user's knee when the suit is worn by the user, and each of the upper and lower leg portions are formed of the roughened material.

9. The suit of claim 8, wherein the roughened material of the upper leg portion for each leg section is incorporated into the suit in a different orientation in relation to the roughened material of the lower leg portion for each leg section such that the rough and smooth directions for the upper leg portion roughened material are transverse the corresponding rough and smooth directions for the lower leg portion roughened material for each leg section.

* * * * *